US009330800B2

(12) United States Patent
Mackie et al.

(10) Patent No.: US 9,330,800 B2
(45) Date of Patent: May 3, 2016

(54) DRY PHASE REACTOR FOR GENERATING MEDICAL ISOTOPES

(71) Applicant: Wisconsin Alumni Research Foundation, Madison, WI (US)

(72) Inventors: Thomas Rockwell Mackie, Verona, WI (US); Thad Alexander Heltemes, Waunakee, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 465 days.

(21) Appl. No.: 13/692,212

(22) Filed: Dec. 3, 2012

(65) Prior Publication Data

US 2014/0153684 A1 Jun. 5, 2014

(51) Int. Cl.

| | |
|---|---|
| ***G21G 1/02*** | (2006.01) |
| ***G21G 1/00*** | (2006.01) |
| ***G21G 1/06*** | (2006.01) |

(52) U.S. Cl.

CPC ..... *G21G 1/001* (2013.01); *G21G 1/06* (2013.01); *G21G 2001/0036* (2013.01)

(58) Field of Classification Search

CPC .. G21G 1/001; G21G 1/06; G21G 2001/0036
USPC ..... 376/186, 189, 202; 423/2
See application file for complete search history.

(56) References Cited

U.S. PATENT DOCUMENTS

| | | | | |
|---|---|---|---|---|
| 3,799,883 | A * | 3/1974 | Arino | 376/186 |
| 3,940,318 | A * | 2/1976 | Arino et al. | 376/186 |
| 4,017,583 | A * | 4/1977 | Motojima et al. | 376/189 |
| 4,332,843 | A * | 6/1982 | Ahuja | 427/237 |
| 5,910,971 | A * | 6/1999 | Ponomarev-Stepnoy et al. | 376/189 |
| 5,917,874 | A * | 6/1999 | Schlyer et al. | 376/202 |
| 6,222,896 | B1 * | 4/2001 | Jia et al. | 376/189 |
| 6,337,055 | B1 * | 1/2002 | Betenekov et al. | 423/2 |
| 7,796,720 | B1 * | 9/2010 | Rubbia | 376/189 |
| 8,249,211 | B2 * | 8/2012 | Buckley | 376/190 |
| 8,989,335 | B2 * | 3/2015 | Tsang | 376/156 |
| 2003/0152187 | A1 | 8/2003 | Ritter | |
| 2009/0162278 | A1 | 6/2009 | Ravn et al. | |
| 2010/0215137 | A1 * | 8/2010 | Nagai et al. | 376/158 |
| 2010/0284502 | A1 | 11/2010 | Piefer | |
| 2011/0096887 | A1 | 4/2011 | Piefer | |
| 2011/0129049 | A1 | 6/2011 | Schenter | |
| 2011/0280356 | A1 * | 11/2011 | Tsang | 376/189 |
| 2011/0305308 | A1 * | 12/2011 | Su | 376/186 |
| 2012/0300891 | A1 * | 11/2012 | Piefer | 376/189 |
| 2013/0142296 | A1 * | 6/2013 | Piefer et al. | 376/190 |

FOREIGN PATENT DOCUMENTS

JP 2000284096 A 10/2000

OTHER PUBLICATIONS

International Search Report of International Application No. PCT/US2013/070750.

OCDE/NEA Expert Group on Criticality Accident Analysis Silene Pulsed Experiments, Silene-Heu-Sol-Step, S10300/1 S2-300/S3-300, Commisariat A L'Energie Atomique, Direction Des Applications Militaires, Department de Recherche Sur Les Materiaux Nucleaires, Service on Neutronique at Criticite, Siege, France.

* cited by examiner

*Primary Examiner* — Jack W Keith
*Assistant Examiner* — Daniel Wasil
(74) *Attorney, Agent, or Firm* — Boyle Fredrickson, S.C.

(57) ABSTRACT

An apparatus for generating medical isotopes provides for the irradiation of dry-phase, granular uranium compounds which are then dissolved in a solvent for separation of the medical isotope from the irradiated compound. Once the medical isotope is removed, the dissolved compound may be reconstituted in dry granular form for repeated irradiation.

19 Claims, 5 Drawing Sheets

DRY PHASE REACTOR FOR GENERATING MEDICAL ISOTOPES

STATEMENT REGARDING FEDERALLY SPONSORED RESEARCH OR DEVELOPMENT

This invention was made with government support under DE-FOA-0000323 awarded by the US Department of Energy. The government has certain rights in the invention.

CROSS REFERENCE TO RELATED APPLICATION

--

BACKGROUND OF THE INVENTION

The present invention relates to a system for generating isotopes useful for medical purposes, such as Mo-99, I-131, Xe-133, Y-90, Cs-137, I-125, and others, and in particular to a system employing a dry, granulated, uranium compound.

Medical isotopes are employed in nuclear medicine where they may be administered to a patient in a form that localizes to specific organs or cellular receptors where they may be imaged with special equipment. Medical isotopes may also be used in the treatment of disease exploiting the tissue-destructive power of short-range ionizing radiation after such localization.

Today, most radioisotopes used in nuclear medicine are produced in nuclear reactors employing highly enriched uranium (HEU). The reactors used for the production of Mo-99 for the United States are outside of the United States requiring the export of HEU and an attendant risk of nuclear proliferation associated with such out-of-country shipments.

It has been proposed to generate medical isotopes using low enriched uranium (LEU) which cannot be used directly to manufacture nuclear weapons. Systems for this purpose are described in US patent applications: 2011/0096887 entitled: "Device and Method for Producing Medical Isotopes" and 2010/0284502 entitled: "High Energy Proton or Neutron Source" hereby incorporated by reference.

In these systems, ions are directed through a target volume holding a gas to generate neutrons. The neutrons may expose a parent fissile material held in solution near the target volume in a fissile solution vessel. In one embodiment the target volume is annular and placed around a cylindrical fissile solution vessel holding the parent material solution. Ions are injected in a spiral through the target volume producing neutrons directed inwardly toward the parent material and outwardly toward a reflector.

Neutrons received in the neutron rich parent fissile material (such as LEU uranium) experience a multiplication in which neutrons striking the parent material generate additional neutrons which strike additional neutron rich material in a chain reaction. In a nuclear reactor, at steady power, the effective neutron multiplication factor ($k_{eff}$) is equal to 1. In a subcritical system, $k_{eff}$ is less than 1.

One problem with aqueous reactors is that it can be difficult to maintain a stable power level. This is because there exist strong feedback mechanisms in the neutron multiplication factor as the temperature of the fissile solution rises and as voids are generated (gas bubbles caused by radiolysis breaking water into hydrogen and oxygen). The rapid reduction in the neutron multiplication factor results in a decrease in power, which causes the neutron multiplication factor to increase again. In particular, a control system that is trying to maintain constant power in the reactor may not be able to react sufficiently fast to adequately control the system. The result is a system with an unstable power level and potential safety impacts.

Co-pending U.S. patent application Ser. No. 13/373,899 filed Dec. 5, 2011, hereby incorporated by reference in its entirety, describes an improved geometry for such aqueous reactors providing a fissile solution vessel in the form of a reduced thickness annulus. By controlling the aspect ratio of the annulus, improved reaction stability is employed and enhanced cooling provided.

SUMMARY OF THE INVENTION

A significant disadvantage of these aqueous processes is that the fission fragments transfer substantial fission energy to the water medium. This energy causes the water molecules to break up into explosive hydrogen and oxygen gas and corrosive species such as hydrogen peroxide. The gases must be recombined in a separate system adding complexity to the aqueous processes and the concentration of hydrogen peroxide may build up in the water and may have to be controlled. Because the fission reactivity of these reactors decreases significantly as the water heats up and/or is radiolysed, and the density drops, recombined water must be returned to the vessel or new water added during operation. Also the pH of the solution has to be monitored and kept acidic to prevent the solution from precipitating.

The present invention provides an improved method and apparatus for generating medical isotopes using a dry-phase granular uranium material such as a uranium compound such as uranium salt or uranium oxide. After irradiation in the dry state, the granular uranium material is dissolved in a solvent and the extraction of the medical isotopes may proceed as is done with aqueous reactors. Eliminating water from the granular uranium material during the irradiation reduces the risk of explosion from hydrogen and oxygen generated by radiolysis, the problems of pH control and water makeup, and other complexities attendant to aqueous reaction. The resulting process is more temperature stable and the processing can operate at temperatures higher than the boiling point of water for more efficient cooling. The granular uranium material is readily dissolved for simplified handling after irradiation.

Specifically then, the present invention provides a method of producing medical isotopes by exposing a dry granular uranium material to radiation to produce the medical isotopes by nuclear reaction. The irradiated uranium material then dissolved in a solvent, typically an acid, and separated from the dissolved uranium material by standard aqueous separation techniques, to provide an isolated medical isotope.

It is thus a feature of at least one embodiment of the invention to eliminate the disadvantages associated with aqueous solutions of uranium salt in producing hydrogen and oxygen through radiolysis such as creates: explosion risks, reaction stability problems, and the need for water makeup during production. It is further an object of the invention to eliminate the need for pH control of an aqueous solution and to avoid operating temperature limitations imposed in the processing of aqueous solutions.

The method may include the step of recrystallizing the granular uranium material by removing the water and recycling the dry granular uranium material through the process again.

It is thus a feature of at least one embodiment of the invention to provide efficient use of the uranium materials.

The method may include the step of cooling the dry granular uranium material by fluid flow in thermal physical contact with the dry uranium salt during irradiation.

It is thus a feature of at least one embodiment of the invention to provide a simple method of temperature control of the granular uranium material without the need for an aqueous solution.

The granular uranium material may be a compound such as a uranium salt or uranium oxide.

It is thus a feature of at least one embodiment of the invention to provide a system that may work with available and well-understood uranium compounds.

The dry granular uranium material may be held in multiple containers and the solvent may be introduced into the containers to dissolve the reacted uranium granular uranium material in the containers for removal from the container in solution form.

It is thus a feature of at least one embodiment of the invention to provide a simple method of transferring granular uranium material in dry form out of the containers.

The method may include placement of one or more radiation reflectors near the dry granular uranium material during irradiation.

It is thus a feature of at least one embodiment of the invention to enlist the radioactivity of the granular uranium material in supporting the desired reaction.

The reaction vessel may include control elements that may be used to controllably absorb radiation and move the control elements to maintain at or near-critical reaction during irradiation.

It is thus a feature of at least one embodiment of the invention to provide a system that may operate as a critical nuclear reactor greatly simplifying its construction.

Alternatively, the radiation may be produced by an electrically powered neutron generator irradiating the dry granular uranium material in a sub-critical reactor.

It is thus a feature of at least one embodiment of the invention to provide a system that may operate sub-critically for simple control.

These particular objects and advantages may apply to only some embodiments falling within the claims and thus do not define the scope of the invention.

DETAILED DESCRIPTION OF THE PREFERRED EMBODIMENT

Figure 1:
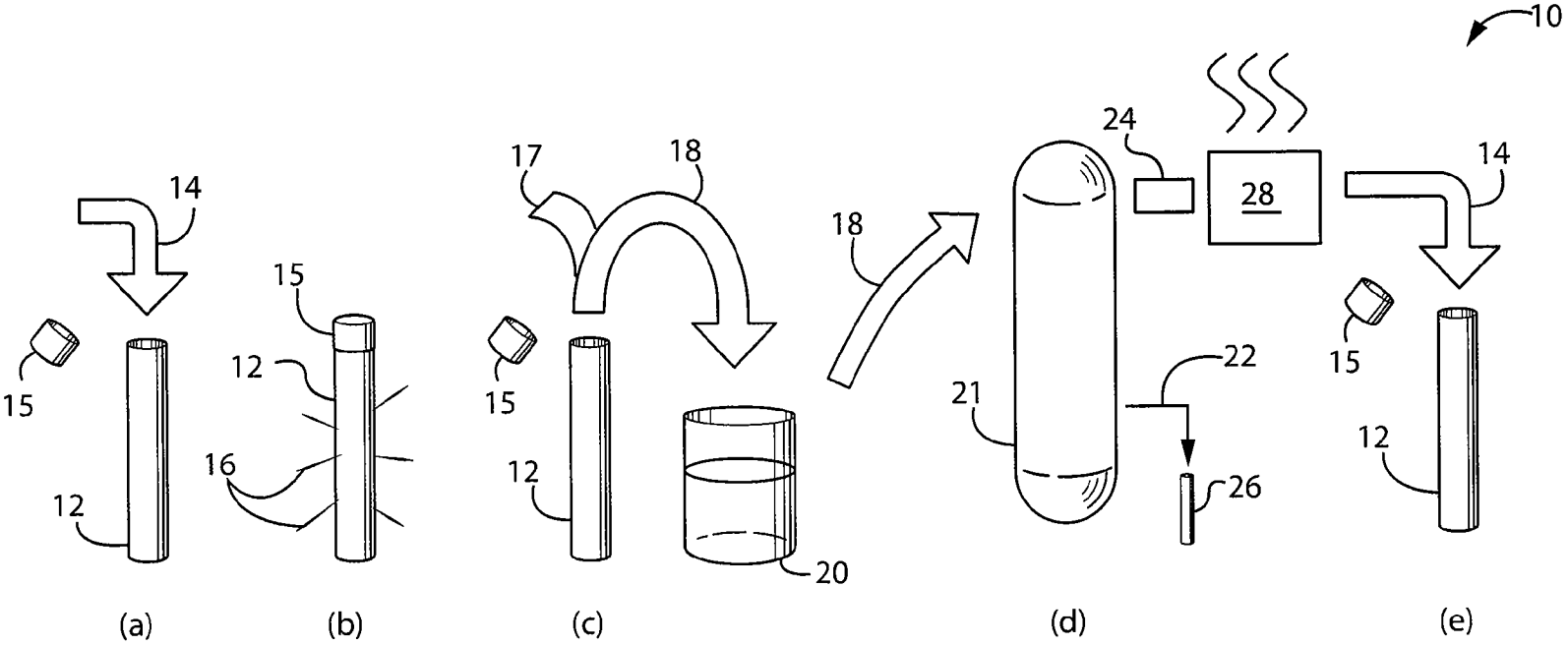
FIGS. 1*a-e* are simplified depictions of the stages of the process of generating a medical isotope from dry granular uranium material held in containers per the present invention.
Figure 2:
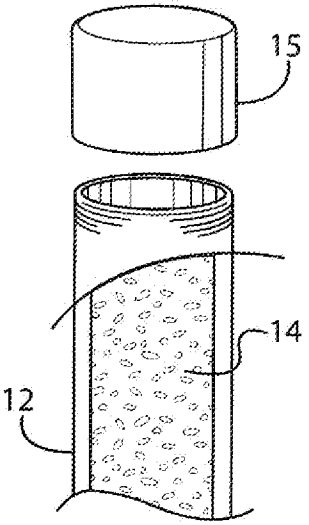
FIG. 2 is a fragmentary cutaway view of a container of FIG. 1 showing contained dry granular uranium material.

Referring now to FIGS. 1*a* and 2, a medical isotope generator 10 per the present invention may provide for containers 12 into which may be placed a dry granular uranium material 14. As used herein, the term granular, refers to a collection of discrete macroscopic particles that may generally flow when poured for placement into the containers 12 without significant clumping caused by Van der Waals forces and that when held in the containers 12 preserve substantial airspace between particles in the filled container 12 that would permit infusion by a solvent. In one embodiment, the grains of dry uranium material 14 may be between 60 micrometers and two millimeters in dimension or alternatively between 125 micrometers and one millimeter in dimension.

As depicted, the containers 12 may be cylindrical tubes closed at one end and having a lid 15 at the opposite end that may be used to provide a removable and replaceable water-tight seal providing an enclosed volume within the container 12. The container 12 make be constructed of a radiation resistant alloy metal such as zircaloy-4 or the like.

At this stage in the process, the granular uranium material 14 is substantially free of all liquid water. Preferably the granular uranium material 14 are loosely packed in the container 12, however, to be either readily removable by pouring or to allow for ready infusion of a solvent at a later stage of the process for dissolving the granular uranium material 14. The granular uranium materials may be a compound such as uranium oxide or uranium salt. The uranium salts may, for example, be uranyl nitrite or uranyl sulfate. Other salts such as uranyl fluoride and uranyl phosphate may also be used. The uranium oxides may, for example, be triuranium octoxide ($U_3O_8$), uranium dioxide ($UO_2$), or uranium trioxide ($UO_3$). Other uranium oxides may also be used.

Referring now to FIGS. 1*b* and 2, the granular uranium material 14 as sealed in the container 12 may be irradiated by neutrons 16 to generate a desired medical isotope through a nuclear reaction caused by the impinging neutrons. The particular reaction may, for example, provide $^{99}$Mo isotope by fission of $^{235}$U in the granular uranium material 14. This process may be conducted at elevated temperatures exceeding the boiling point of water typically moderated by a cooling fluid flow, for example, around the outer surfaces of the container 12 or through channels formed inside the container 12 as will be discussed below.

Referring to FIG. 1(*c*), after irradiation, the contained granular uranium material and medical isotope may be dissolved with water, an aqueous acid solution, or other solvent 17 to form a solution 18. In one embodiment, the solvent is nitric acid for uranyl nitrate and uranium oxides, and sulfuric acid is used for uranyl sulfate salts. For uranyl fluoride and uranyl phosphate the solvent could be hydrofluoric acid or phosphoric acid, respectively. The solution 18 may the product of a removal process in which the dry granular uranium material 14 are moved from the container 12 by flushing water through the interior volume of the container 12 into an accumulating container 20. Alternatively, the invention contemplates that the dry granular uranium material 14 may be removed from the container 12 by other means such as pouring or augering and then mixed with the solvent in the accumulating container 20.

Referring now to FIG. 1(*d*), however formed, the solution 18 may then be provided to a separator 21 for separating out a medical isotope 22 from the water/uranium salt mixture 24. The separator 21, for example, may make use of adsorption column of titania or alumina. A LEU-modified Cintichem may then be used to purify the moly (primarily by iodine removal) after extraction from the solution to provide a source of the desired medical isotopes, particularly $^{99}$Mo. The medical isotope may be placed in containers 26 to be transported to a location of use.

The remaining water/uranium salt mixture 24 may be recrystallized by a recycler 28, for example, by cooling the water/uranium salt mixture 24 to promote crystallization of the uranium salts followed by a decanting of the water and/or thermal evaporation of the water. The reconstituted dry uranium granular material 14 may then be replaced in a container 12 and this process repeated per the foregoing description.

Figure 3:
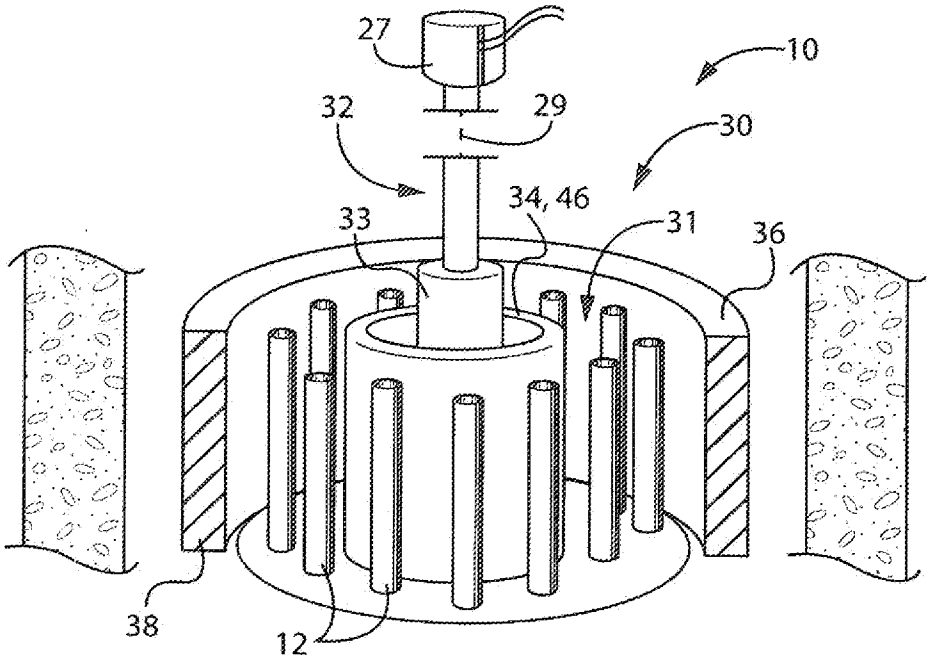
FIG. 3 is a perspective view in cross-section of multiple containers of FIG. 2 or 4 arranged in a reaction chamber employing a subcritical reaction process using an external neutron source.

Referring now to FIG. 3, in one embodiment the containers 12 may be placed in a subcritical reactor 30, for example, providing a reaction chamber 31 having the dimensions of a cylindrical annulus and in which the containers 12 are placed in a circle at an equal distance from a central axis 29 of the reaction chamber 31 and oriented parallel to the central axis 29. The general construction of this subcritical reactor 30 will be similar to that described in the above co-pending U.S. patent application Ser. No. 13/373,899 with respect to features surrounding the reaction chamber 31. Specifically, electronically accelerated ions from an electronically controlled and powered ion accelerator 27 may pass downward through an axially extending trap assembly 32 to strike a target gas held within a cylindrical target chamber 33 concentric with the reaction chamber 31. The cylindrical target chamber 33 produces neutrons that pass radially outward into the reaction chamber 31 after passing through a coaxial and cylindrical wall 34 of a neutron multiplier/moderator material. The neutron multiplier/moderator material may be, for example, an aluminum-clad beryllium metal, or depleted uranium or other similar material that multiplies fast neutrons passing outward from the target chamber 33 and moderates fast neutrons traveling inward from the annular reaction chamber 31. The excess heat of the neutron multiplier/moderator 46 is removed by water jackets (not shown for clarity) which allow control of the temperature of the neutron multiplier/moderator 46 to ensure the escape of sufficient neutrons from the target chamber 33 while moderating neutrons received from the reaction chamber 31. In one embodiment, the neutron multiplier/moderator 46 may provide a 1.5-3.0 multiplication factor such as may be adjusted by adjusting its thickness.

The outside of the reaction chamber 31 may be bounded by a cylindrical outer annular reflector 36 surrounding and coaxial with an annular reaction chamber 31. This reflector, for example, may be an aluminum walled chamber filled with a reflector material 38 which, in one embodiment, may be heavy water having a volume, for example, of 1000 liters. The reflector material 38 increases the generation efficiency by reflecting neutrons back into the reaction chamber 31 and therefore may also permit reaction control by draining water from the reflector 36 thus reducing the neutron reflection into the reaction chamber 31. This approach may also be used in controlling a critical reactor assembly as will be discussed below.

Referring now to FIGS. 1(*b*) and 5, during operation, the irradiating neutrons 16 described above with respect to FIG. 1 will be produced both by the neutron ion accelerator 27 acting on the gas of the target chamber 33 and additional neutrons 16 generated in a chain reaction from the granular uranium material. Generally, the medical isotope generator 10 will be controlled to provide the desired level of neutron bombardment of the containers 12 necessary to produce the desired medical isotope per FIG. 1(*b*) as described above while operating with an effective neutron multiplication factor ($k_{eff}$) less than 1. This control may be affected by control of the ion accelerator 27 and/or control of moderating elements, for example, controlling the reflector 36 as described above with respect to water level or other control techniques described herein or well-known.

During the irradiation process, the containers 12 and the contained dry granular uranium material may be controlled in temperature by natural convection or a pumping of a chilled fluid around them, for example, a chilled gas or liquids such as water. In the case where cooling water is used, a thin water jacket around each container 12 may be employed or the size of the reaction chamber 31 carefully limited to reduce the necessary volume of water and thereby suppress an undesirable feedback mechanism in neutron multiplication factor caused by voids generated in the water (gas bubbles caused by radiolysis breaking water into hydrogen and oxygen) changing the neutron multiplication factor.

Figure 4:
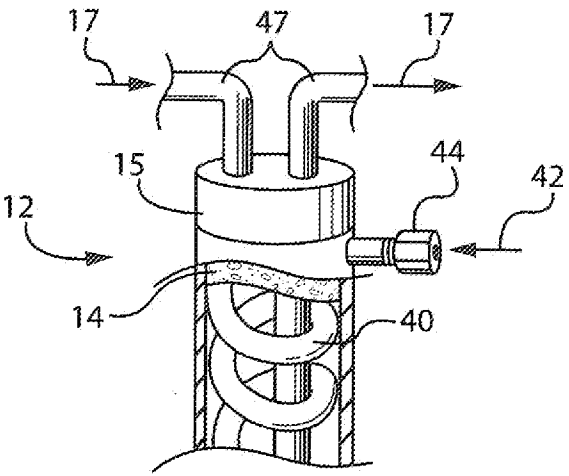
FIG. 4 is a figure similar to that of FIG. 2 showing an alternative embodiment of the containers of FIG. 2 having cooling channels and flushing channels therein.

Referring now to FIGS. 1 and 4, in one embodiment, the containers may include an internal water circulation channel 40, for example a helix of metal tubing, that may receive and discharge cooling water 42 through external connections 44 (only one shown) to provide cooling of the contained granular uranium material 14 packed around the water circulation channel 40 with thermal connection thereto but in physical isolation. Rapid circulation, separation from the reactive materials and the limited volume of water minimizes the radiolysis problem. Other cooling liquids than water may be used including those providing cooling at higher operating temperatures than the boiling point of water.

In addition or alternatively, each container 12 may provide for a pair of flushing connections 47, one that will receive water 42 from an external source and introduce it into the container 12, and one that will expel the received water into the accumulating container 20 during the extraction of the granular uranium material 14 from the container 12 per the discussion of FIG. 1(*c*). In this way, the removal of the granular uranium material 14 may be accomplished easily even if the granular uranium material 14 are packed or caked in the container 12 after irradiation. Generally the containers may remain in the reaction chamber 31 until needed, being subject to continual neutron bombardment.

Figure 5:
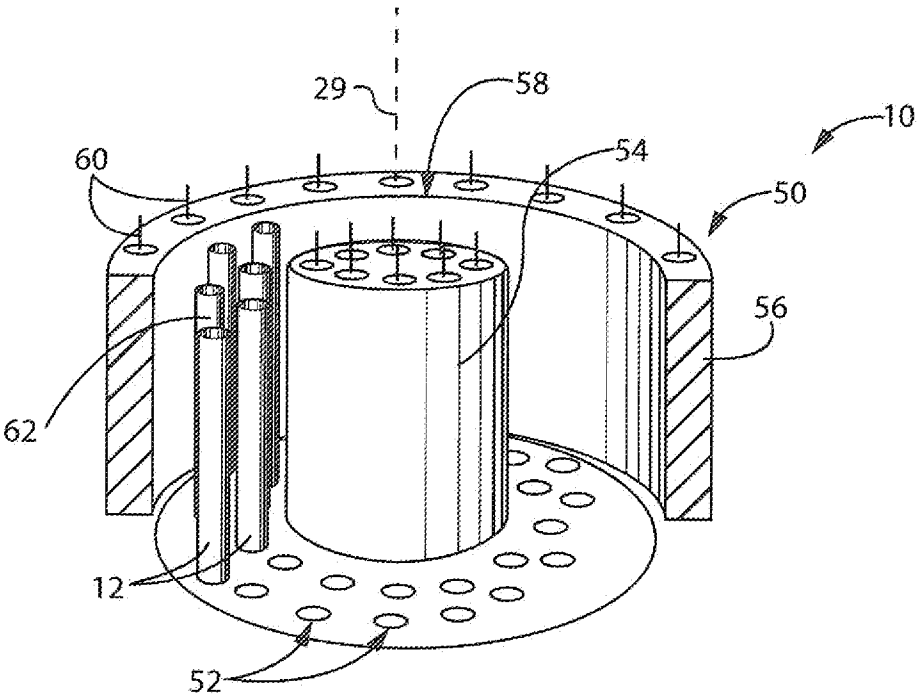
FIG. 5 is a perspective view in cross-section of the containers of FIG. 2 or 4 arranged in a reaction chamber employing a critical reaction process.

Referring also to FIG. 5, the above present invention may also work with a critical reactor 50 operating with an effective neutron multiplication factor ($k_{eff}$) equal to 1. In this system, multi-layered rows 52 of containers 12 may be placed in corresponding circles about a reflector core 54 and within a reflector shell 56 defining an annular space of a reaction chamber 58 similar to reaction chamber 31. The containers 12 may be a vertically oriented to be parallel to the axis 29 of the annular reaction chamber 58. One or both of the reflector core 54 and reflector shell 56 may include removable control rods 60 that may be used to control the resulting chain reaction and/or control rods (not shown) may be interspersed among the containers 12. In one embodiment, fuel rods 62 may also be interspersed in the rows 52 to promote the necessary nuclear reactions; however, it is believed that no such additional fuel rods 62 are required. The critical reactor 50 may otherwise be operated in a manner similar to a conventional nuclear reactor with the control rods 60 adjusted to promote the desired neutron multiplication factor using a feedback or other control system, for example, operating on an electronic computer according to a stored program.

EXAMPLE I

A simulation was performed on a double row of containers 12 arranged according to the parameters of following Table I in a critical reaction chamber per FIG. 4.

TABLE I

| Parameter | Quantity | Unit |
|---|---|---|
| Row 1 Number of Tubes | 30 | |
| Row 1 Tube Angular Spacing | 12.00 | deg |
| Row 1 Tube Axis Radial Distance | 20.3160 | cm |
| Row 1 Distance Between Tubes | 1.311 | cm |
| Row 2 Number of Tubes | 36 | |
| Row 2 Tube Angular Spacing | 10.00 | deg |
| Row 2 Tube Axis Radial Distance | 25.1320 | cm |
| Row 2 Distance Between Tubes | 1.445 | cm |
| Tube Inner Diameters | 2.54 | cm |
| Oxide Volume per Tube | 506.7 | cc |
| Total Oxide Volume | 33.443 | Liters |
| Total Uranium Mass | 207.519 | kg |
| Adjusted Cold $k_{eff}$ | 1.00000 | |
| Adjusted Hot $k_{eff}$ | 0.99957 | |
| Fission rate | 1.496E+17 | f/s |
| Specific fission rate | 7.209E+14 | f/kgU-s |
| Irradiation Time | 5.5 | days |
| 99Mo Activity EOI | 185329.3 | Ci |

Figure 6:
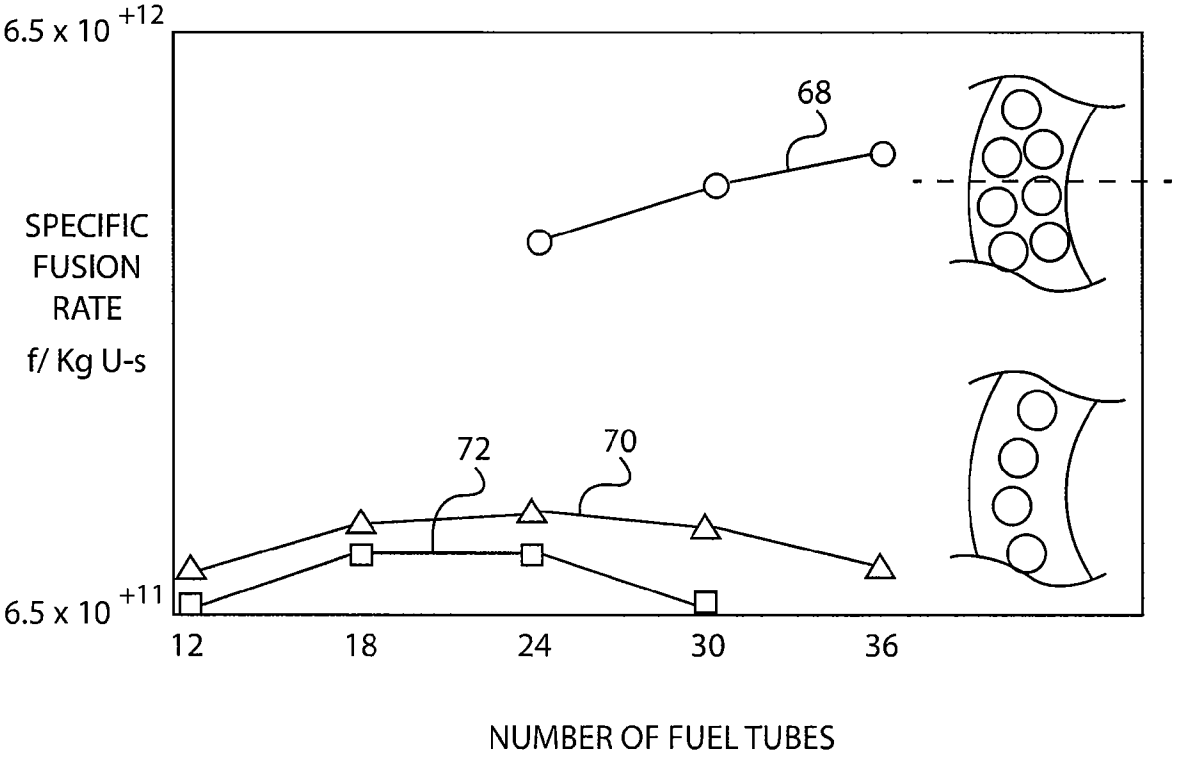
FIG. 6 is a plot of specific fission rate with different container arrangements.

As shown in FIG. 6, this configuration provides substantially higher specific fission rates, as indicated by curve 68, in comparison to a single row of containers 12 per curve 70 or a single row of larger diameter containers (1.25 inches) per curve 72. This is true over a range of different numbers of containers 12. The higher specific fission rate promotes increased efficiency in the generation of medical isotopes. With 66 containers 12, the medical isotope generator 10 could run continuously as a critical reactor 50 without the need of fuel rods 62 described above.

It will be generally appreciated that the annular reaction chambers 31 and 58 need not be a cylindrical annulus but may take on other annular shapes such as a polygonal and that the term annular should be understood to include an annulus having an upper and/or lower solid base. Generally, each of the components including the neutron multipliers and reflectors may be cooled by water jackets that are not shown. The circulation of chilled water within the water jackets may be controlled by a feedback controller to control the temperature of the water to a predetermined value or to a dynamic value based on a monitoring of the general reaction rate by other means. In addition, the feedback controller may manage other control variables such as control of height of the water and/or control rods to control reaction rates. Generally, the medical isotope generator 10 will be further shielded with concrete and water according to standard practices. Other isotopes such as $^{131}$I, $^{133}$Xe, and $^{111}$In may also be produced by a similar structure.

Figure 7:
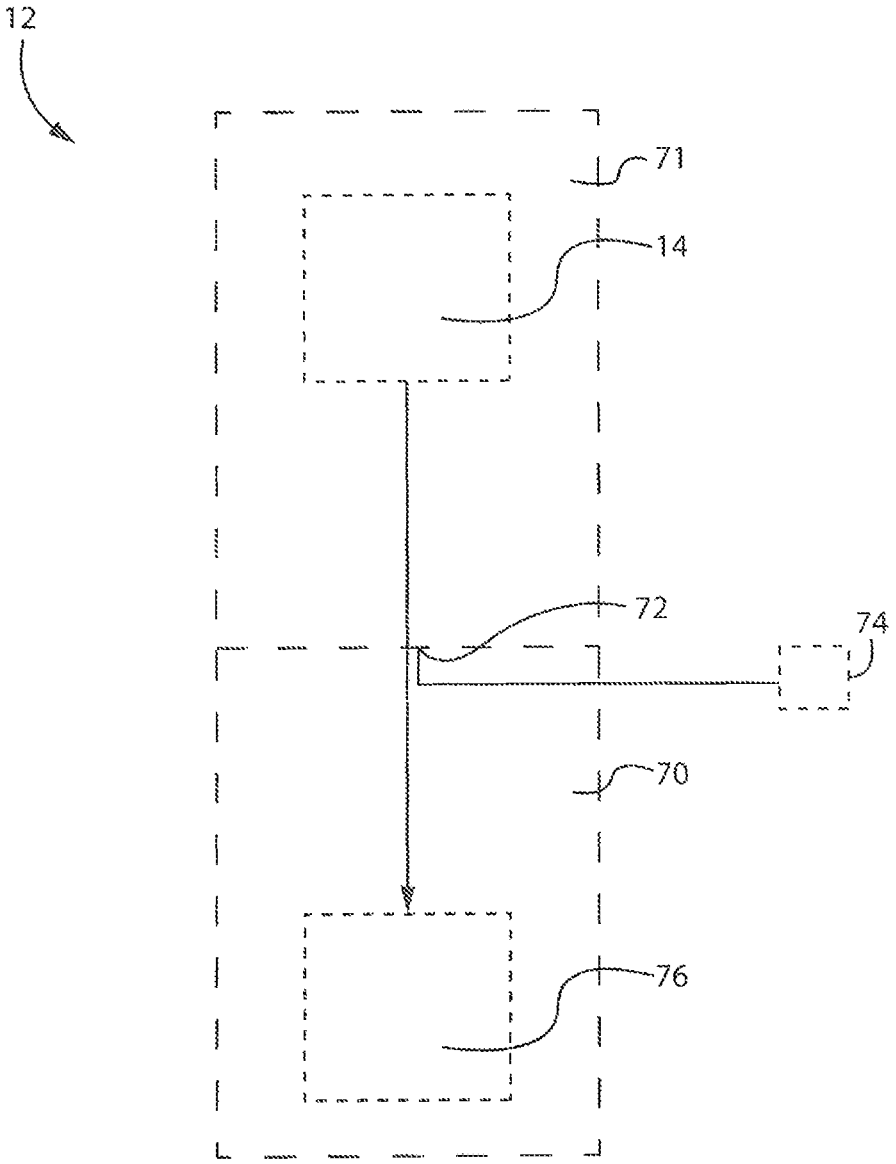
FIG. 7 is a block diagram of an alternative container of FIG. 1 providing for a rapid fuel dispersion feature.

Referring now to FIG. 7, an alternative container 12 may provide for a lower discharge portion 70 positioned below a dump valve 72 separating the discharge portion 70 from an upper portion 71 normally holding the granular uranium material 14 and being, for example, a cylindrical tube into which the granular uranium material 14 is closely packed. In a closed state, the dump valve 72 holds the granular uranium material 14 in the upper portion 71.

The dump valve 72 may be activated for example by an external guide linkage 74 or cable and may be biased by a spring or the like (not shown) to an open state for fail-resistant operation. In the open state, the dump valve 72 allows the granular uranium material 14 to drop rapidly into the lower portion 70 where the granular uranium material 14 is geometrically separated and/or isolated by neutron absorbing barriers 76 to rapidly quench an ongoing nuclear reaction. The system may be used independently or together with the control rods described above.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

What we claim is:

1. A method of producing medical isotopes using an apparatus having:

a reactor chamber configured to control irradiation of material contained in the reaction chamber;

a plurality of containers that are together removably insertable into the chamber, wherein each respective container comprises container walls, wherein the container walls define an enclosed container interior, wherein the container interior includes a volume holding a dry granular uranium compound, wherein the reaction chamber is configured to control irradiation of dry granular uranium compound held in a container inserted into the reaction chamber, to cause generation of an isotope, wherein each respective container includes a cooling channel that passes through the container interior while being inwardly spaced from the container walls, wherein the cooling channel comprises tubing, wherein the tubing is configured to receive cooling fluid, wherein the tubing is configured to allow received cooling fluid to flow therein through the container interior while the cooling fluid is both in thermal contact with the dry granular uranium compound, and physically isolated from the contained dry granular uranium compound; and a material processor having a separator operably configured to process the dry granular uranium compound by (a) dissolving the dry granular uranium in a solvent and then (b) separating the isotope from the granular uranium compound, the method comprising the steps of:

(a) exposing a dry granular uranium compound to radiation to produce the medical isotope by nuclear reaction;

(b) dissolving the irradiated uranium compound in a solvent; and (c) separating the medical isotope from the solventized uranium compound to provide an isolated medical isotope.

2. The method of claim 1 wherein the uranium compound is selected from the group consisting of uranium oxides and uranium salts.

3. The method of claim 1 wherein the uranium salt is selected from the group consisting of uranyl nitrite or uranyl sulfate.

4. The method of claim 1 further including the step of (d) reconstituting the dry granular uranium compound by removing the solvent and repeating steps (a)-(c).

5. The method of claim 1 wherein the solvent is an acid selected from the group consisting of nitric acid and sulfuric acid.

6. The method of claim 1 further including the step of cooling the dry granular uranium compound by a flow of fluid in thermal physical contact with the granular uranium compound during step (a).

7. The method of claim 1 wherein the medical isotope is $^{99}$Mo.

8. The method of claim 1 wherein in step (a) the dry granular uranium compound is held in multiple containers and wherein step (b) dissolves the irradiated uranium compound in the solvent in the containers and then removes the solvent from the containers along with the dissolved uranium compound.

9. The method of claim 1 further including placement of one or more reflectors reflecting radiation near the dry granular uranium compound during irradiation.

10. The method of claim 1 including the step of moving neutron absorbing control elements in a region near the dry granular uranium compound during irradiation to maintain critical reaction during step (a).

11. The method of claim 1 wherein the radiation is produced by an electrically powered neutron generator irradiating the dry granular uranium compound in a sub-critical reactor.

12. An apparatus for producing medical isotopes comprising:

a reaction chamber configured to control irradiation of material contained in the reaction chamber;

a plurality of containers that are together removably insertable into the reaction chamber, wherein each respective container comprises container walls, wherein the container walls define an enclosed container interior, wherein the container interior includes a volume holding a dry granular uranium compound, wherein the reaction chamber is configured to control irradiation of dry granular uranium compound held in a container inserted into the reaction chamber, to cause generation of an isotope, wherein each respective container includes a cooling channel that passes through the container interior while being inwardly spaced from the container walls, wherein the cooling channel comprises tubing, wherein the tubing is configured to receive cooling fluid, wherein the tubing is configured to allow received cooling fluid to flow therein through the container interior while the cooling fluid is both in thermal contact with the dry granular uranium compound, and physically isolated from the contained dry granular uranium compound; and a material processor having a separator operably configured to process the dry granular uranium compound by (a) dissolving the dry granular uranium in a solvent, and then (b) separating the isotope from the granular uranium compound.

13. The apparatus of claim 12 wherein each respective container includes a second channel comprising tubing wherein the tubing is configured to allow a received stream of water to pass into the container interior while the stream of water is in contact with the dry granular uranium compound to dissolve and flush the dry granular uranium compound from the container.

14. The apparatus of claim 12 wherein each respective container includes at least one barrier for distributing the dry, granular uranium compound into a geometrical configuration that does not support sustained nuclear reaction.

15. The apparatus of claim 12 further including one or more reflectors reflecting radiation near the dry granular uranium compound during irradiation.

16. The apparatus of claim 12 wherein the uranium compound is selected from a group consisting of uranium oxides and uranium salts.

17. The apparatus of claim 16 wherein the uranium salt is selected from the group consisting of uranyl nitrite or uranyl sulfate.

18. The apparatus of claim 12 wherein the solvent is an acid selected from a group consisting of nitric acid and sulfuric acid.

19. The apparatus of claim 12 wherein the containers are arranged in at least two concentric rings.

* * * * *